United States Patent [19]

Shu

[11] 4,431,056

[45] Feb. 14, 1984

[54] STEAM FLOOD OIL RECOVERY PROCESS

[75] Inventor: Winston R. Shu, Dallas, Tex.

[73] Assignee: Mobil Oil Corporation, New York, N.Y.

[21] Appl. No.: 293,759

[22] Filed: Aug. 17, 1981

[51] Int. Cl.[3] ..... E21B 43/24

[52] U.S. Cl. ..... 166/263; 166/272

[58] Field of Search ..... 166/263, 272, 303, 306

[56] References Cited

U.S. PATENT DOCUMENTS

| | | | |
|---|---|---|---|
| 3,129,758 | 4/1964 | Closmann | 166/272 X |
| 3,372,750 | 3/1968 | Satter et al. | 166/272 |
| 3,430,700 | 3/1969 | Satter et al. | 166/263 X |
| 3,707,189 | 12/1972 | Prats | 166/263 |
| 4,022,280 | 5/1977 | Stoddard et al. | 166/306 X |
| 4,026,359 | 5/1977 | Closmann | 166/263 |
| 4,166,502 | 9/1979 | Hall et al. | 166/272 X |
| 4,321,966 | 3/1982 | Traverse et al. | 166/263 |

*Primary Examiner*—George A. Suchfield
*Attorney, Agent, or Firm*—Alexander J. McKillop; James F. Powers, Jr.; Lawrence O. Miller

[57] ABSTRACT

The vertical conformance of a steam drive process is improved by conducting the steam flood process in two stages. In the first stage, steam is injected into the lower portion of the formation via an injection well and oil is recovered from the upper portion of the formation via a spaced apart production well. Once there is a breakthrough of steam at the production well, injection of steam and production are terminated. In the second stage, the roles of the injection well and production well are reversed. A thermal recovery fluid comprising steam or hot water is injected into the lower portion of the formation via the production well and oil is recovered from the lower portion of the formation via the injection well until the oil recovered contains an unfavorable amount of steam or water.

2 Claims, 2 Drawing Figures

STEAM FLOOD OIL RECOVERY PROCESS

FIELD OF THE INVENTION

The present invention pertains to a steam drive process for recovering viscous oil from a subterranean, viscous oil-containing formation. More particularly, the present invention involves an improved steam drive and recovery method utilizing a reverse steam flood which increases the vertical conformance of the steam process.

BACKGROUND OF THE INVENTION

Many oil reservoirs have been discovered which contain vast quantities of oil, but little or no oil has been recovered from many of them because the oil present in the reservoir is so viscous that it is essentially immobile at reservoir conditions, and little or no petroleum flow will occur into a well drilled into the formation even if a natural or artificially induced pressure differential exists between the formation and the well. Some form of supplemental oil recovery must be applied to these formations which decreases the viscosity of the oil sufficiently that it will flow or can be dispersed through the formation to production well and therethrough to the surface of the earth. Thermal recovery techniques are quite suitable for viscous oil formations, and steam flooding is the most successful thermal oil recovery technique yet employed commercially.

Steam may be utilized for thermal stimulation for viscous oil production by means of a steam drive or steam throughput process, in which steam is injected into the formation on a more or less continuous basis by means of an injection well and oil is recovered from the formation from a spaced-apart production well. While this process is very effective with respect to the portion of the recovery zone between the injection well and production well through which the steam travels, poor vertical and horizontal conformance is often experienced in steam drive oil recovery processes. By vertical conformance, it is meant the portion of the vertical thickness of a formation through which the injected steam passes. A major cause of poor vertical conformance is caused by steam, being of lower density than other fluids present in the permeable formation, migrating to the upper portion of the oil formation to the remotely located production well. Once steam channeling has occurred in the upper portion of the formation, the permeability of the steam-swept zone is increased due to the desaturation or removal of oil from the portion of the formation through which steam has channeled. Thus subsequently-injected steam will migrate almost exclusively through the steam-swept channel and very little of the injected steam will move into the lower portions of the formation, and thus very little additional oil from the lower portion of the formation will be produced. While steam drive processes effectively reduce the oil saturation in the portions of the formation through which they travel by a significant amount, a large portion of the recovery zone between the injection and production systems is not contacted by steam and so a significant amount of oil remains in the formation after completion of the steam drive oil recovery process. The severity of the poor vertical conformance problem increases with the thickness of the oil formation and with the viscosity of the oil contained in the formation.

In view of the foregoing discussion, it can be appreciated that there is a substantial, unfulfilled need for a method of conducting a well-to-well throughout steam injection oil recovery method in a manner which results in improved vertical conformance.

SUMMARY OF THE INVENTION

The process of the present invention involves an improved steam drive recovery process with at least one injection well and at least one spaced-apart production well for injecting steam into the lower portion of the formation and recovering oil from the upper portion of the formation. Due to gravitational effects, the vapor phase steam migrates in an upper direction thereby passing through only a small fraction of the full vertical thickness of the formation. Once there is a breakthrough of steam at the top of the production well, the roles of the injection well and production well are reversed. At this point, a thermal recovery fluid such as steam, low quality steam or preferably hot water is injected into the lower portion of the formation through the production well and oil is recovered from the lower portion of the formation through the injection well until the oil being recovered contains an unfavorable amount of thermal recovery fluid. The reverse thermal fluid flooding in the lower portion of the formation recovers oil from that portion of the formation not contacted by the steam injected in the first step thereby increasing the overall recovery efficiency of oil from the formation.

DESCRIPTION OF THE PREFERRED EMBODIMENTS

Figure 1:
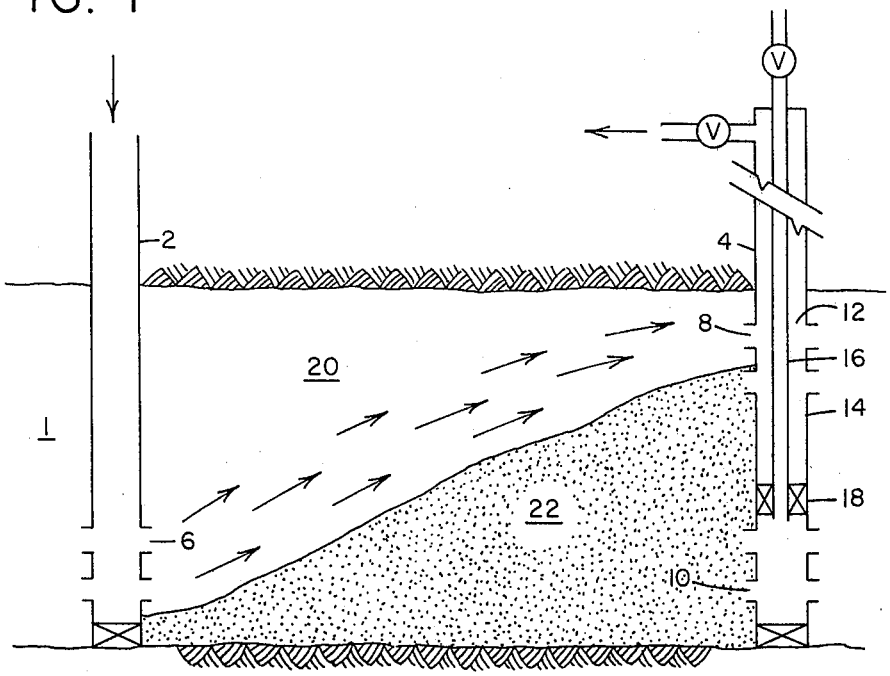
FIG. 1 illustrates a subterranean formation protected by an injection well and a production well being employed in a state-of-the art steam drive recovery method in which steam is injected into the lower portion of the formation and oil production from the top of the producer, illustrating how the injected steam migrates to the upper positions of the formation as it travels through the recovery zone within the formation and between the injection well and production well, thus bypassing a significant amount of oil in the recovery zone.

The problem of steam override for which the process of our invention represents a solution may best be understood by referring to the attached drawings, in which FIG. 1 illustrates how a relatively thick, viscous oil formation 1 is penetrated by an injection well 2 and a production well 4, the injection well being in fluid communication with the lower portion of the formation by means of perforation 6 and the production well is a dually completed production well, with one flow path in fluid communication with the upper portion of the formation by means of perforation 8 and a second flow path in fluid communication with the lower portion of the formation by means of perforation 10. The annular space 12 between well casing 14 and tubing 16 is used as the first communication path while tubing 16 is used for the second communication path. Packer 18 isolates the annular space 12, the packer being about midway between upper perforations 8 and lower perforations 10.

In the first step of my process, steam is injected into well 2, passes through the perforations 6 in well 2 into the lower portion of the viscous oil formation 1, and oil is produced to the surface via the communication path of well 4 in fluid communication with the upper part of the formation 1, which in this embodiment is the annular space 12 between casing 14 and tubing 16 of production well 4. The steam being injected into the formation is saturated, which simply means that there is present both a liquid phase and a gaseous phase simultaneously at the point of injection. Ordinarily saturated steam is defined in terms of quality by specifying the weight fraction which is in the vapor phase. Thus, 80 percent quality steam means that 80 percent of the steam on the basis of weight is vapor with the remaining 20 percent being liquid phase. It is generally satisfactory to use steam in the quality range from about 40 to 100 percent. It can be seen that the steam injected into the formation via injection well 2 migrates both horizontally and in an upward direction as it moves through the formation between injection well 2 and production well 4. The result is the creation of a steam-swept zone 20 in the upper portion of the formation and zone 22 in the lower portion of the formation through which little or no steam has passed. Steam injection and production of oil is continued until there is a steam breakthrough at production well 4 via the first communication path. FIG. 1 depicts the condition in the formation at about the time steam breakthrough has occurred at the top of well 4. Once steam is being produced in well 4, further production of oil will be at a much diminished rate because continued injection of steam will not cause any steam to flow through zone 22, because (1) the specific gravity of the substantially all vapor phase steam is significantly less than the specific gravity of the petroleum and other liquids present in the pore spaces of the formation, and so gravitational effects will cause the steam vapors to be confined exclusively in the upper portion of the formation, and (2) steam passage through the upper portion of the formation displaces and removes petroleum from that portion of the formation through which it travels, and desaturation of the zone increases the relative permeability of the formation significantly as a consequence of removing the viscous petroleum therefrom. Thus any injected fluid will travel more readily through the desaturated portion of the formation 20 than it will through the portion of the formation 22 which is near original conditions with respect to viscous petroleum saturation. At this point, injection of steam and production is terminated and the flow path is communicated with the top of the formation in solution.

Figure 2:
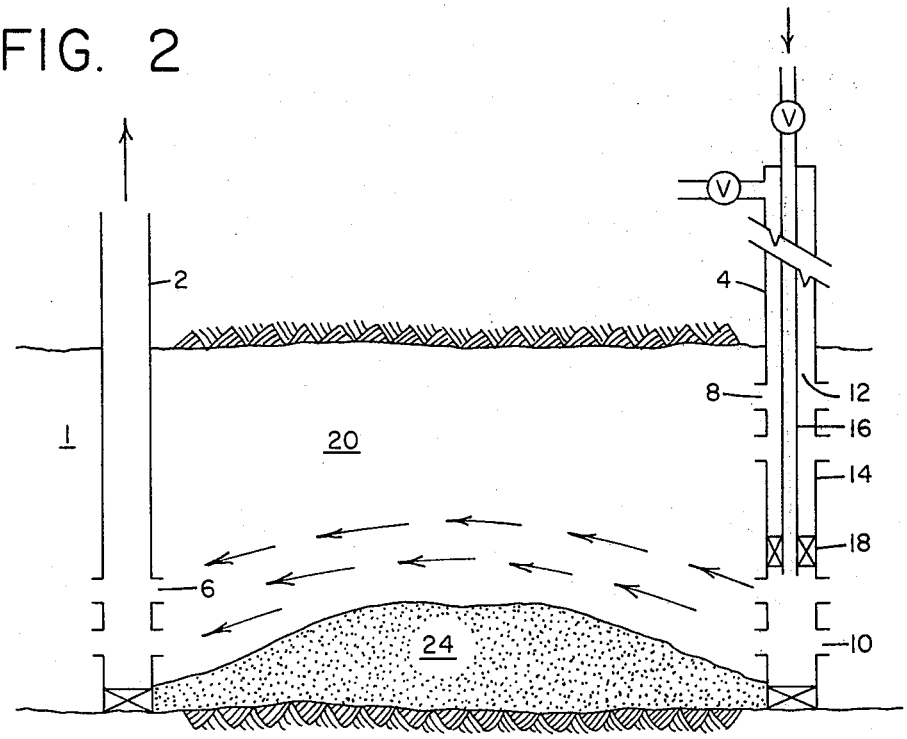
FIG. 2 illustrates the second phase of my process in which the roles of the injection and production wells are reversed, illustrating how a thermal recovery fluid passes through the portion of the recovery zone in the formation not swept by the steam drive process applied in the first step.

In the second step of my process, production well 4 is utilized as a production well and injection well 2 is utilized as a production well. The second step of reverse thermal fluid flooding accomplished substantial thermal stimulated recovery of oil from zone 22 which is not recovered during the first step as illustrated in FIG. 1. A thermal recovery fluid comprising hot water or steam is injected into the lower portion of the formation adjacent to the production well by means of tubing 16 and fluids including oil are recovered from the lower portion of the formation via injection well 2. Since there is a large amount of heat introduced in the formation by the steam injected during the first step, hot water or low quality steam are the preferred thermal recovery fluids for the reverse flooding step thereby increasing the thermal efficiency of the process. Hot water is further preferred because if the thermal recovery fluid injected into well 4 is substantially all in the liquid phase gravity focus will help ensure that the injected fluid travels in the lower portion of the oil saturated zone between well 4 and well 2 and not contacted by vapor phase steam during the previous step. This step is continued with thermal fluid injected into well 4 and fluid production being taken from the bottom perforations of well 2 until thermal fluid production at well 2 occurs to an unfavorable extent. At this point, injection of the thermal recovery fluid is terminated along with production. In FIG. 2, it can be seen that a portion 24 still remains unswept by the injected thermal recovery fluid, but it is significantly less than the volume of zone 22 prior to application of the second step of my process.

The present invention may be carried out utilizing injection and production systems as defined by any suitable arrangement of wells. One well arrangement commonly used in waterflooding operations and suitable for use in carrying out the present invention is an integrated five-spot pattern of the type illustrated in U.S. Pat. No. 3,927,716 to Burdyn et al. Other well arrangements may be used in carrying out the present invention, examples of which are set forth in the Burdyn et al. patent.

What is claimed is:

1. A method for recovering viscous oil from a subterranean, permeable, viscous oil-containing formation, said formation being penetrated by at least two wells, one injection well and one production well, said injection well being in fluid communication with the lower portion of the formation, said production well containing two flow paths from the surface, the first being in fluid communication with at least a portion of the upper part of the formation, and the second being in fluid communication with at least a portion of the lower part of the formation, comprising:

(a) injecting steam into only the lower portion of the formation via the injection well and producing fluids including oil from the upper portion of the formation via the first path in the production well until vapor phase steam production occurs at the production well *thereby sweeping oil primarily in the upper portion of the formation between the injection well and the production well;* and (b) thereafter injecting a thermal recovery fluid comprising steam as hot water into the lower portion of the formation via the second flow path in the production and recovering fluid from the lower portion of the formation via the injection well until the fluid bearing recovered from the injection well comprises an unfavorable amount of steam or water *thereby sweeping oil primarily in the lower portion of the formation between the injection well and the production well whereby the vertical conformance of the steam drive is significantly improved and oil recovery is enhanced.*

2. A method as recited in claim 1 wherein the thermal fluid injected into the formation via the production well according to step (b) comprises low quality steam.

* * * * *